United States Patent [19]

Shimamura et al.

[11] 4,066,461

[45] Jan. 3, 1978

[54] COLOR PHOTOGRAPHIC PROCESS

[75] Inventors: Isao Shimamura; Shoji Ishiguro; Junkichi Ogawa, all of Minami-ashigara, Japan

[73] Assignee: Fuji Photo Film Co., Ltd., Minami-ashigara, Japan

[21] Appl. No.: 735,936

[22] Filed: Oct. 27, 1976

[30] Foreign Application Priority Data

Oct. 27, 1975 Japan ..... 50-129100

[51] Int. Cl.[2] ..... G03C 5/30

[52] U.S. Cl. ..... 96/66.3; 96/66.4; 96/66.5

[58] Field of Search ..... 96/66 R, 66.3, 66.4, 96/66.5, 22, 56

[56] References Cited

U.S. PATENT DOCUMENTS

| | | | |
|---|---|---|---|
| 3,212,900 | 10/1965 | Oguchi et al. | 96/109 |
| 3,255,013 | 6/1966 | Dersch et al. | 96/107 |
| 3,291,607 | 12/1966 | Dersch et al. | 96/22 |
| 3,647,439 | 3/1972 | Bass | 96/29 |
| 3,910,790 | 10/1975 | Lohmer et al. | 96/66.5 |

FOREIGN PATENT DOCUMENTS

| | | | |
|---|---|---|---|
| 628,202 | 3/1936 | Germany | 96/66 R |

*Primary Examiner*—Mary F. Kelley

*Attorney, Agent, or Firm*—Sughrue, Rothwell, Mion, Zinn and Macpeak

[57] ABSTRACT

A color photographic process which comprises processing silver halide color photographic materials using a color developer containing a 2-alkyne-1-ol represented by the general formula:

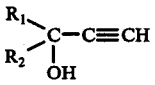

wherein $R_1$ and $R_2$ each represents a hydrogen atom, an alkyl group, a hydroxyalkyl group, an aminoalkyl group, a carboxyalkyl group, or a formylalkyl group, and $R_1$ and $R_2$ may be the same or different.

By using the above compound in a color photographic process, the speed of color development can be effectively promoted without increasing fog, and, further, the stability of the color developer is improved.

5 Claims, No Drawings

COLOR PHOTOGRAPHIC PROCESS

BACKGROUND OF THE INVENTION

1. Field of the Invention

The present invention relates to processing color photographic materials, and, in particular, to a color photographic process which effectively promotes the color developing speed without increasing the formation of fog and further improves the stability of the color developer.

2. Description of the Prior Art

In color photographic processing, a color photographic material comprising a support having coated thereon silver halide photographic emulsions containing or not containing cyan, yellow and magenta couplers is image-wise exposed and then subjected to a series of processings for forming images as dye images.

The fundamental steps of color photographic processing are a color development step and a silver removal step. That is, in the color development step, the exposed silver halide in the silver halide color photographic material oxidizes a color developing agent and at the same time is reduced to silver, and, further, the oxidized color developing agent undergoes a coupling reaction with any couplers present to give dye images. The color photographic material thus developed is then processed in a silver removal step in which the developed silver formed in the color development step is oxidized by the action of an oxidizing agent (called a "bleaching agent") and the oxidized silver is dissolved away from the photographic material by a complexing agent for silver ion (called a "fixing agent"). Thus, the photographic material processed has formed thereon only dye images.

In a practical development process, the process further includes auxiliary steps for retaining photographic and physical qualities of the color images and to improve the stability or preservability of color images, in addition to the above-mentioned two fundamental steps of color development and silver removal. For example, there are usually employed a hardening bath for preventing light-sensitive emulsion layers being excessively softened during processing, a stop bath to effectively stop the development reaction, a stabilization bath to stabilize the color images formed, and a bath for removing a backing layer from the support of the color photographic material. Such a kind of color photographic process has been conventionally practiced since 1940.

As a photographic process other than the above-mentioned processing system, a color intensification process is sometimes employed and such a process is described in detail in, for example, U.S. Pat. No. 3,674,490; and in Japanese Patent Applications Laid Open (OPI) 9728/'73 and 9729/'73.

It is further known that an amine compound or an alcohol can be incorporated in a developer for promoting development speed. Examples of such known amine compounds are, for example, alkylamines as described in U.S. Pat. No. 2,196,037, aralkylamines as described in U.S. Pat. Nos. 2,496,903; 2,515,147; and 2,541,889, phenoxyalkylamines as described in U.S. Pat. No. 2,482,546, heterocyclic alkylamines as described in U.S. Pat. No. 2,608,183, morpholine, piperidine, etc., as described in U.S. Pat. No. 2,304,025, and xylylenediamines as described in U.S. Pat. No. 1,086,618. Also, examples of alcohols used for this purpose are aralkyl alcohols as described in U.S. Pat. No. 2,304,925.

However, while the above-mentioned amines may promote development speed to some extent in color development, the formation of fog increases with increases in development speed. Moreover, when a color developer containing such an amine is used after being stored for a long period of time, it causes fog and color mixing, or, further, the color developer is accompanied by the formation of coloring and precipitates.

When an aralkyl alcohol is incorporated in a color developer, the development speed may be promoted to some extent, but since an aralkyl alcohol has essentially low solubility in water, when a color developer containing an aralkyl alcohol is allowed to stand, oil drops form therein. It is known to use glycols as an auxiliary solvent for preventing the formation of such oil drops in the color developer, but the use of such glycols insufficiently improves the solubility of aralkyl alcohols in water.

Recently, the concentration of color developers used has tended to be higher, and, with increased requirements for using such highly concentrated color developers, the technique of keeping such highly concentrated color developers stable becomes more and more important. On the other hand, however, in the case of using an aralkyl alcohol, it is difficult to employ the same for practical purposes in a highly concentrated color developer for the reasons stated above.

SUMMARY OF THE INVENTION

A primary object of this invention is to provide a color photographic process which effectively increases the color development speed without increasing the formation of fog and improves the preservability of the color developer. As a result of various investigations, it has been discovered that the aforementioned object of this invention can be attained by processing color photographic materials using a color developer containing a 2-alkyne-1-ol represented by the general formula

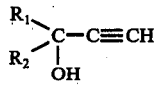

wherein $R_1$ and $R_2$, which may be the same or different, each represents a hydrogen atom, an alkyl group, a hydroxyalkyl group, an aminoalkyl group, a carboxyalkyl group, or a formylalkyl group; the alkyl group or alkyl residue preferably having 1–4 carbon atoms.

DETAILED DESCRIPTION OF THE INVENTION

The main feature of the process of this invention lies in the point of incorporating the 2-alkyne-1-on shown by the above general formula in a color developer. Preferred examples thereof are illustrated in the following table, in which $R_1$ and $R_2$ represent those in the above-described general formula. However, the compounds shown in the table are intended to illustrate the 2-alkyne-1-ols used in this invention but not to limit them in any way.

| Compound | $R_1$ | $R_2$ |
|---|---|---|
| 1 | H | $CH_3$ |
| 2 | $CH_3$ | $CH_3$ |
| 3 | $CH_3$ | $C_2H_5$ |

-continued

| Compound | $R_1$ | $R_2$ |
|---|---|---|
| 4 | $CH_3$ | $HOCH_2$ |
| 5 | $C_2H_5$ | $NH_2CH_2$ |
| 6 | $C_2H_5$ | $HOOCC_2H_4$ |
| 7 | $C_2H_5$ | $OHCCH_2$ |

Compounds 1 and 2 illustrated in the above table are described in Japanese Patent Publication 22,067/'64 and Compounds 1 to 3 are commercially available. The compounds of this invention shown by the above general formula can be prepared by conventional methods, for example, following the procedure as described in Thomas F. Rutlege "Acetylenes and Allenes", 1969, Reinhold Book Corporation, New York.

The amount of the 2-alkyne-1-ol shown by the above general formula added to a color developer is usually about 0.1 to about 100 g, preferably 1 to 50 g, per liter of the color developer. Also, the 2-alkyne-1-ol of the general formula may be used together with a development accelerator such as disclosed in L. F. A. Mason, "Photographic Processing Chemistry", pages 41 to 44 (1966), Focal Press Ltd., for example, an aralkyl alcohol (such as benzyl alcohol), a quaternary ammonium salt, an organic amine and polyethylene oxides, etc., and such an embodiment is preferred in this invention.

It is to be specifically noted that the effects of the present invention do not depend upon the particular constituents of any color developer utilized, and sufficient effects appear in any system which involves the use of a silver halide or halides and one or more p-phenylenediamine developing agents, as are commonly used in the art.

The color developer used in this invention is used at a temperature of about 20° to about 60° C., preferably higher than 30° C., more preferably 30° to 45° C.

The pH of the color developer used in this invention is in a range of about 7 to about 14, preferably about 8 to 13.

The color development of the present invention is not particularly limited insofar as the time of development is concerned, but the time of development is preferably about 5 seconds to about 20 minutes, even more commonly and more preferably from 10 seconds to 5 minutes.

The development, in accordance with conventional procedures in the art, is performed at atmospheric pressure, of course.

There is no particular limitation on the developer ingredients to be added to the color developer used in this invention, other than the compound of the above general formula.

An ordinary p-phenylenediamine type color developing agent can be used in the color developer in this invention as the color developing agent, and, further, other additives as are usually employed in this field of the art may, if desired or necessary, be added to the color developer. Practical examples of these additives are described in, for example, the specification of Japanese Patent Application 84,081/'75, page 9, last line to page 17, line 11.

Also, there is no particular restriction on the color photographic materials processed in this invention and, for example, the color photographic materials described in the specification of the aforesaid Japanese Patent Application, from page 17, line 12 to page 29, line 5 can be used in this invention.

The color photographic process of the invention is superior to conventional processes in the following points: the speed of color development can be effectively promoted without increasing the formation of fog and the color developer employed in this invention shows improved stability. These merits are particularly remarkable in the case of performing color photographic processing at high temperatures e.g., higher than 30° C., preferably at temperatures of 30° to 45° C.

Typical examples of the color photographic processings in this invention and typical examples of the processing compositions used in these processings are shown below, and those described in the examples of this application; they are not limited to these illustrations, however. Each step of the following color negative photographic processings was performed at a temperature of 38° C.

| Color negative processing | |
|---|---|
| Processing step | Time |
| Color development | 3 min. |
| Stop | 1 " |
| Wash | 1 " |
| Bleach | 2 " |
| Wash | 1 " |
| Fix | 2 " |
| Wash | 1 " |
| Stabilization | 1 " |

The composition of the color developer used above was as follows:

| Color developer | |
|---|---|
| Sodium hydroxide | 2 g. |
| Sodium sulfite | 2 g. |
| Potassium bromide | 0.4 g. |
| Compound 2 | 10 ml. |
| Sodium chloride | 1 g. |
| Borax | 4 g. |
| Hydroxylamine sulfate | 2 g. |
| Disodium ethylenediamine tetraacetate di-hydrate | 2 g. |
| 4-Amino-3-methyl-N-ethyl-N-(β-hydroxyethyl)aniline.monosulfate | 4 g. |
| Water to make | 1 liter |

The following color reversal photographic processing was performed at a temperature of 40° C.

| Color reversal processing | |
|---|---|
| Processing step | Time |
| First development | 5 sec. |
| Color development | 15 " |
| Stop | 10 " |
| Bleach stabilization | 90 " |

The composition of the color developer used above was as follows:

| Color developer | |
|---|---|
| Sodium sulfite | 5 g. |
| Hydroxylamine sulfate | 2 g. |
| Compound 1 | 10 ml. |
| 4-Amino-3-methyl-N-ethyl-N-(β-hydroxyethyl)aniline sulfate | 10 g. |
| Trisodium phosphate ($12H_2O$) | 100 g. |
| Trihydroxymethyl nitromethane | 3 g. |
| Ethylenediamine (70 wt.% aqueous solution) | 11 ml. |
| Sodium hydroxide | 0.1 g. |
| Water to make | 1 liter. |

The following intensification photographic processing was performed at a temperature of 40° C. except the final wash step which was performed at 26° C.

| Intensification processing | |
|---|---|
| Processing step | Time |
| Color development | 1 min. |
| Intensification | 2 " |
| Blix | 1 " |
| Wash | 2 " |

The composition of the color developer used above was as follows:

| Color developer | |
|---|---|
| Benzyl alcohol | 15 ml. |
| Compound 2 | 10 ml. |
| Potassium sulfite | 3.5 g. |
| Potassium bromide | 0.5 g. |
| Hydroxylamine sulfate | 2.0 g. |
| 4-Amino-3-methyl-N-ethyl-N-(β-hydroxyethyl)aniline monosulfate | 7.5 g. |
| Sodium carbonate | 30 g. |
| Nitrilotriacetic acid | 5 g. |
| Water to make | 1 liter. |

One intensification process to which this invention is applicable is disclosed in Japanese Patent Applications Laid Open (OPI) 9728/'73 and 9729/'73.

Having thus generally described the invention, the following examples illustrate currently preferred modes of practicing the present invention without limiting the same.

EXAMPLE 1

A color photographic paper was prepared by coating, on a polythylene coated paper support, in succession, a blue-sensitive silver bromide emulsion containing an emulsified dispersion of a yellow coupler, a green-sensitive silver chlorobromide emulsion (70 mole% silver chloride) containing an emulsified dispersion of a magenta coupler, a red-sensitive silver chlorobromide emulsion (70 mole% silver chloride) containing an emulsified dispersion of a cyan coupler, and a gelatin composition containing an ultraviolet absorber (the coated amount of an ultraviolet absorber was 0.01 g/m²).

Each of the coupler emulsions used for preparing the color photographic paper was prepared by dissolving each coupler in a mixture of dibutyl phthalate and tricresyl phosphate and dispersing the solution of the coupler in an aqueous gelatin solution of the O/W type using sorbitan monolaurate, Turkey red oil and sodium dodecylbenzenesulfonate as dispersing agents.

As the couplers in the silver halide photographic emulsions of the color photographic paper, α-(2-methylbenzoyl)-aceto-(2-chloro-5-dodecoxycarbonyl-)anilide as the yellow coupler, 1-(2,4,6-trichlorophenyl)-3-[3,(2,4-di-t-amylphenoxyacetamido)benzamido]-5-phrazolone as the magenta coupler, and 1-hydroxy-4-chloro-2-n-dodecylnaphthamide as the cyan coupler were used, respectively. Also, the ultraviolet absorbent used was

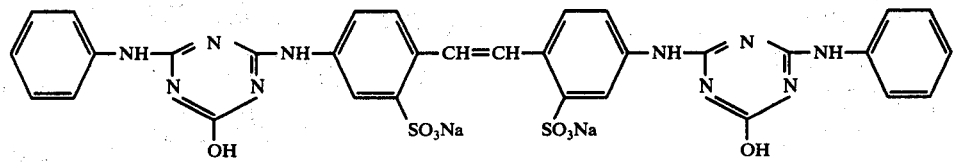

Furthermore, 5-methyl-7-hydroxy-1,3,4-triazaindolizine was used as an antifoggant, i.e., a 2% aqueous solution of 5-methyl-7-hydroxy-1,3,4-triazaindolizine was added to each emulsion so as to be present in an amount of 0.01 mol/Ag mol, addition being just before the emulsion was coated.

The coated amounts of the couplers and silver halide in the color photographic paper thus prepared were as follows:

| | Coated amount of Coupler | Coated amount of Silver halide |
|---|---|---|
| | (g/m²) | (Ag g/m²) |
| Red-sensitive layer | 0.4 | 0.5 |
| Green-sensitive layer | 0.5 | 0.6 |
| Blue-sensitive layer | 0.4 | 0.8 |

The photographic element was sensitometrically exposed (1 second, 500 C. M. S.) and then processed as follows:

| Processing step | | |
|---|---|---|
| Color developer | 31° C. | 3 min. 30 sec. |
| Blix | " | 1 min. 30 sec. |
| Wash | " | 2 min. |
| Stabilization | " | 1 min. |

The compositions of the processing solutions used in the above processings were as follows:

| | |
|---|---|
| Color developer | |
| Sodium sulfite | 2 g. |
| Potassium bromide | 0.5 g. |
| Sodium carbonate (monohydrate) | 30 g. |
| 4-Amino-N-ethyl-N-(β-methanesulfonamido)-m-toluidine(sesquisulfate, monohydrate) | 5 g. |
| Additive (see Table 1) | |
| Water to make | 1 liter. |
| Blix solution | |
| Ammonium thiosulfate (70 wt.% aqueous solution) | 150 ml. |
| Sodium sulfite | 5 g. |
| Na[Fe(EDTA)] | 40 g. |
| EDTA | 4 g. |
| Water to make | 1 liter. |
| (EDTA: Ethylenediamine tetraacetic acid) | |
| Stabilization solution | |
| Glacial acetic acid | 10 ml. |
| Sodium acetate | 5 g. |
| Formalin (37 wt.% aqueous solution) | 5 ml. |
| Water to make | 1 liter |

The results obtained are shown in Table 1.

Table 1

| Test No. | Additive to the Color Developer | Optimum amount | Magenta Fog | Magenta Relative sensitivity | Magenta Maximum density |
|---|---|---|---|---|---|
| | | (mole/1.) | | | |
| 1 | None (control) | — | 0.08 | 55 | 2.36 |
| 2 | Diethylene glycol | 0.042 | 0.08 | 57 | 2.38 |

Table 1-continued

| Test No. | Additive to the Color Developer | Optimum amount | Magenta Fog | Relative sensitivity | Maximum density |
|---|---|---|---|---|---|
| | (comparison) | | | | |
| 3 | Diethylene glycol + | 0.042 | 0.08 | 100 | 2.44 |
| | Benzyl alcohol (comparison) | 0.139 | | | |
| 4 | Compound 2 | 0.042 | 0.08 | 71 | 2.43 |
| 5 | Compound 2 + | 0.042 | 0.08 | 132 | 2.47 |
| | Benzyl alcohol | 0.139 | | | |

As can be understood from the above results, the compound of this invention (Test No. 4) had a higher development promoting action than that of diethylene glycol (Test No. 2). That is, when diethylene glycol in the diethylene glycol and benzyl alcohol system (Test No. 3) was replaced by Compound 2 at an equimolar amount (Test No. 5), the effective development promoting effect was obtained without increasing fog.

EXAMPLE 2

Color developers were prepared in the same manner as in Example 1 and after being allowed to stand for one week at room temperature, the preservability of the developers was measured. The results are shown in Table 2.

Table 2

| Test No. | Additive to color developer | Amount | Precipitates after 1 week |
|---|---|---|---|
| | | (mole/l) | |
| 6 | None (control) | — | none |
| 7 | Diethylene glycol + | 0.042 | observed (oil |
| | Benzyl alcohol (comparison) | 0.278 | drops) |
| 8 | Compound 1 + | 0.042 | none |
| | Benzyl alcohol | 0.278 | |
| 9 | Compound 2 + | 0.042 | none |
| | Benzyl alcohol | 0.278 | |
| 10 | Compound 3 + | 0.042 | none |
| | Benzyl alcohol | 0.278 | |

As can be understood from the above results, when the compound of this invention was used as an auxiliary solvent for benzyl alcohol (Test Nos. 8–10), the preservability of the color developers was improved effectively as compared with the case of using diethylene glycol as an anxiliary solvent for benzyl alcohol.

It is to be noted that benzyl alcohol is not a necessary material for the present invention, but benzyl alcohol can be used together with the compounds of the present invention. The amount of benzyl alcohol is preferably 0 to 50 ml per 1 liter of developer, more preferably 0 to 20 ml per 1 liter of developer.

EXAMPLE 3

The same procedure as in Example 1 was followed while 0.139 mole/liter of benzyl alcohol was further added to the color developer together with each additive shown in Table 3, and the photographic properties were measured in each case. The results obtained are shown in Table 3.

Table 3

| Test No. | Additive to color developer | Amount | Magenta Fog | Relative sensitivity |
|---|---|---|---|---|
| | | (mole/1.) | | |
| 11 | None (control) | — | 0.09 | 100 |
| 12 | Compound 1 | 0.05 | 0.10 | 157 |
| 13 | Compound 2 | 0.05 | 0.09 | 132 |
| 14 | Compound 3 | 0.05 | 0.08 | 124 |
| 15 | Polyethylene glycol (mol. weight 1540) | 0.005 | 0.09 | 93 |
| 16 | 2-Methylimidazole | 0.05 | >0.02 | — |

As can be understood from the above results, the compounds of this invention more effectively promoted the color development than polyethylene glycol or 2-methylimidazole which are well known as additives for the same purpose.

While the invention has been described in detail and with reference to specific embodiments thereof, it will be apparent to one skilled in the art that various changes and modifications can be made therein without departing from the spirit and scope thereof.

What we claim is:

1. A color photographic process which comprises processing imagewise exposed silver halide color photographic materials by a p-phenylene-diamine color developer containing a 2-alkyne-1-ol represented by the general formula

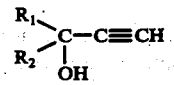

wherein $R_1$ and $R_2$, which may be the same or different, each represents a hydrogen atom, an alkyl group, a hydroxyalkyl group, an aminoalkyl group, a carboxyalkyl group, or a formylalkyl group.

2. The color photographic process of claim 1 in which said color developer contains said compound of the general formula in an amount of about 0.1 to about 100 g per liter of the color developer.

3. The color photographic of claim 1 in which said color developer contains the compound of the general formula together with another development accelerator different from the 2-alkyne-1-ol.

4. The color photographic process of claim 3 where the development accelerator is benzyl alcohol.

5. The color photographic process of claim 3 where any alkyl group or moiety as $R_1$ and $R_2$ has 1 to 4 carbon atoms.

* * * * *